US011530578B2

(12) United States Patent
Harbison et al.

(10) Patent No.: US 11,530,578 B2
(45) Date of Patent: Dec. 20, 2022

(54) BEND STIFFENER

(71) Applicant: CRP Subsea Limited, Skelmersdale (GB)

(72) Inventors: Austin Harbison, Skelmersdale (GB); Hussain Mohammed Bilal, Skelmersdale (GB)

(73) Assignee: CRP SUBSEA LIMITED, Skelmersdale (GB)

( * ) Notice: Subject to any disclaimer, the term of this patent is extended or adjusted under 35 U.S.C. 154(b) by 0 days.

(21) Appl. No.: 17/050,780

(22) PCT Filed: May 2, 2019

(86) PCT No.: PCT/GB2019/051218
§ 371 (c)(1),
(2) Date: Oct. 26, 2020

(87) PCT Pub. No.: WO2019/211612
PCT Pub. Date: Nov. 7, 2019

(65) Prior Publication Data

US 2021/0071480 A1 Mar. 11, 2021

(30) Foreign Application Priority Data

May 4, 2018 (GB) ..... 1807370

(51) Int. Cl.
*E21B 17/01* (2006.01)
*E21B 7/12* (2006.01)

(52) U.S. Cl.
CPC ..... *E21B 17/017* (2013.01); *E21B 7/122* (2013.01)

(58) Field of Classification Search
CPC combination set(s) only.
See application file for complete search history.

(56) References Cited

U.S. PATENT DOCUMENTS 9,388,642 B2 7/2016 Mangal et al.
10,385,624 B2 8/2019 Duggan et al.
(Continued)

FOREIGN PATENT DOCUMENTS

FR 2871511 A1 12/2005
GB 2506001 B 11/2015
(Continued)

OTHER PUBLICATIONS

European Patent Office, International Search Report in PCT App. No. PCT/GB2019/051218, dated Jul. 17, 2019, pp. 1-4.
(Continued)

*Primary Examiner* — Kyle Armstrong
(74) *Attorney, Agent, or Firm* — Cahn & Samuels, LLP

(57) ABSTRACT

The invention concerns a bend stiffener (10, 32) for locally protecting an elongate flexible member (14) from excessive curvature when the elongate flexible member is deployed in water. The bend stiffener comprises an elongate stiffener body (34) which has a root end, a free end, and a passage (36) extending through the stiffener body from the root end to the free end for receiving and embracing the flexible member. A coupling (16) at or toward the root end of the stiffener body serves to mount the stiffener body. The stiffener body is sufficiently flexible to curve somewhat along with the flexible member when the flexible member suffers a bending load and carries a sensor module which is located proximate the free end of the bend stiffener and is configured to sense inclination and/or orientation and/or movement of the free end of the bend stiffener.

20 Claims, 22 Drawing Sheets

(56) References Cited

U.S. PATENT DOCUMENTS

| | | | |
|---|---|---|---|
| 10,472,900 | B2 | 11/2019 | Harbison et al. |
| 2011/0176125 | A1 | 7/2011 | Smith et al. |
| 2017/0299369 | A1 | 10/2017 | McNab et al. |
| 2019/0214801 | A1 | 7/2019 | Smith et al. |

FOREIGN PATENT DOCUMENTS

| | | | |
|---|---|---|---|
| GB | 2541722 | A | 3/2017 |
| WO | 2015/189291 | A1 | 12/2015 |
| WO | 2017/093725 | A1 | 6/2017 |

OTHER PUBLICATIONS

European Patent Office, Written Opinion in PCT App. No. PCT/GB2019/051218, dated Jul. 17, 2019, pp. 1-6.

BEND STIFFENER

The present invention is concerned with monitoring of elongate flexible underwater members. Specifically it concerns monitoring of such members using a bend stiffener carrying a suitable sensor arrangement.

Flexible underwater members include subsea pipes such as risers used to conduct hydrocarbons from a wellhead on the sea floor to a production platform, but the invention is applicable in relation to any of a wide range of risers, pipelines, flowlines, umbilicals, cables, power cables or the like.

Elongate members deployed underwater can suffer variable bending stress and consequent variable strain (bending) which can cause fatigue and so limit their working lifetime. They may also suffer damage if caused to bend more tightly than their minimum bend radius. Consider the example of a gas or oil riser leading from the seabed to a floating platform. Wave action causes cyclical bending and unbending, especially in the vicinity of the riser termination at the platform. Water currents can impose lateral loads on the riser, creating bending stress.

Failure of risers can be through collapse, rupture of internal lines or even rupture of external layers leading to release of hydrocarbons to the environment, and can result from long term fatigue damage or from a single instance of catastrophic over-bending. Risers and their ancillaries thus need to be designed taking account of expected operating conditions to provide the required design lifetime, which can be in excess of twenty years. The state of the riser may be periodically assessed as a basis for decisions about maintenance, remedial action or replacement.

Risers may be visited and inspected periodically, by divers or by a camera equipped remotely operated vehicle ("ROV"), but inspection is not in itself a complete solution to monitoring of the state of the riser.

There have been proposals in the past for use of sensors to monitor bending of risers, which is desirable not only as a basis for such periodic assessment but also as a way to improve the design of future risers and their related structures.

US 2011/0176125 (Smith et al.) describes a system for monitoring bending of a flexible riser which uses an elongate conduit strapped to the riser. In one embodiment the conduit has embedded optical fibres incorporating Bragg gratings used to measure strain of the fibres and so to sense bending of the conduit.

U.S. Pat. No. 9,388,642B2 (Mangal et al.) discloses an arrangement having a "sensor carrier apparatus" formed as two half tubes assembled around the riser and again using optical fibre Bragg grating strain gauges to measure bending. This document also proposes provision on the sensor carrier apparatus of an inclinometer.

These arrangements using additional items secured to the riser, such as the carrier apparatus of Mangal, add to the expense and complexity of the installation as a whole and to the work involved in its deployment.

GB2506001B (Silixa Ltd. and Chevron USA Inc.) discloses an approach to monitoring of the profile of a riser using optical fibre distributed acoustic sensors capable of detecting sound at short intervals along the riser's length. The system is somewhat elaborate, involving emission of acoustic signals from multiple sources deployed at known positions with respect to the riser. Positions of the sensors are calculated from the received acoustic signals to enable the profile of the riser to be determined. The cost of implementing and maintaining such a system is thought to be potentially large.

It is conventional to protect a riser from local over-bending in the region of its termination at the platform by use of a bend stiffener. One known form of bend stiffener 10 is represented, in simplified form, in FIG. 1 and comprises a frusto-conical stiffener body 12 with a cylindrical through-going passage (which is internal detail not seen in this drawing) receiving and embracing a flexible riser 14 passing though the bend stiffener. Steelwork 16 serves to mount a wider root 18 of the bend stiffener to some termination structure (not shown) such as an "I" tube of a production platform. In this way the stiffener body 12 is mounted in cantilever fashion, its root 18 being fixed and its narrower, free, end 20 being able to move as the stiffener body 12 and the riser 14 within it flex under a bending load. The drawing shows the stiffener body 12 to be curved but this is the effect of such loading, in the absence of which the stiffener body 12 is straight in this example. The stiffness of the frusto-conical body reduces progressively from the root 18 to the free end 20 and in this way the bend stiffener distributes a bending moment over its length, ensuring that the riser is not subject to a localised—and potentially large—bending moment where it emerges from the platform.

The elongate member being protected extends into the water. The bend stiffener may itself be submerged, or it may be above the water surface e.g. in what is referred to as the "splash zone".

Not all bend stiffeners are mounted in this cantilever fashion and not all are deployed at or near the water surface. "Mid-line" bend stiffeners serve to protect regions of an underwater member away from its termination.

WO 2015/189291 discloses a bend stiffener provided at its root end with a number of strain gauges which appear from the drawings to be embedded in the body of the stiffener at its root end. From the measured strains, and based on a predetermined bending characteristic of the stiffener, it is said that it can be determined whether the stiffener has bent beyond a minimum radius of curvature. The document also suggests measurement of temperature in this connection. But embedding sensors in the highly stressed root portion of the stiffener is potentially problematic in that it may affect the fatigue lifetime of the stiffener itself, and may create local stress concentration leading to propagation of cracks or splits in the stiffener material. The approach described involves use of multiple sensors circumferentially spaced about the bend stiffener and connected by what appears to be hard wiring to electronics including a processing unit and memory. This is an undesirably complex arrangement and the accommodation of hard wiring and of electronics in the stressed root end of the stiffener would again involve the possibility of compromising the fatigue lifetime of the stiffener.

An improved means of monitoring underwater flexible members is thus desired. Desirably it should be simple and robust in manufacture and should not add to the complexity of deployment of the elongate member.

In accordance with the present invention there is a bend stiffener for locally protecting an elongate flexible member from excessive curvature when the elongate flexible member is deployed in water, the bend stiffener comprising an elongate stiffener body which has

- a root end,
- a free end, and
- a passage extending through the stiffener body from the root end to the free end for receiving and embracing the flexible member, the bend stiffener further comprising a coupling at or toward the root end of the stiffener body for mounting the stiffener body, the stiffener body being sufficiently flexible to curve somewhat along with the flexible member when the flexible member suffers a bending load and carrying a sensor module which is proximate the free end of the bend stiffener and is configured to sense inclination and/or orientation and/or movement of the free end of the bend stiffener.

In accordance with a second aspect of the present invention there is a stiffener body for a bend stiffener, for locally protecting an elongate flexible member from excessive curvature when the elongate flexible member is deployed in water, the stiffener body comprising a root end, a free end, and a passage extending through the stiffener body from the root end to the free end for receiving and embracing the flexible member, the stiffener body having a tip portion at or proximate the free end which is configured to receive and mount a sensor module.

Specific embodiments of the present invention will now be described, by way of example only, with reference to the accompanying drawings, in which:—

FIG. 1 is a simplified view of a bend stiffener viewed from one side and receiving a riser;

FIG. 2*a* represents part of a bend stiffener embodying the present invention;

FIG. 2*b* is similar to FIG. 2*a* except that the bend stiffener is shown cut through in a plane perpendicular to its axis, to reveal internal detail; FIG. 2*c* represents part of a further bend stiffener embodying the present invention;

FIGS. 3*a* and 3*b* respectively represent a further bend stiffener embodying the present invention and a sensor module for use with it;

FIG. 4 represents a further bend stiffener embodying in the present invention which is cut away in an axial plane to reveal interior detail;

FIGS. 5*a* and 5*b* represent part of a further bend stiffener embodying the present invention and differ in that in FIG. 5*b* the stiffener is cut away in an axial plane to reveal interior detail; FIG. 5*c* is a detail view, once more cut away in an axial plane, of the same bend stiffener;

FIG. 6*a* represents part of a further bend stiffener embodying the present invention; FIG. 6*b* represents a sensor module used in the bend stiffener; FIG. 6*c* is a detail view of part of the same bend stiffener from which the sensor module is omitted;

FIG. 7*a* represents part of a further bend stiffener embodying the present invention; FIG. 7*b* represents a clamp used with the bend stiffener; FIG. 7*c* represents the bend stiffener without the clamp;

FIG. 8*a* represents part of a yet a further bend stiffener embodying the present invention; FIG. 8*b* represents a clamp used with the bend stiffener; FIG. 8*c* represents the bend stiffener without the clamp;

FIG. 9*a* represents a bend stiffener embodying the present invention and carrying a sensor module, the sensor module being cut through in an axial plane to reveal internal detail; FIG. 9*b* represents the bend stiffener without the sensor module; FIG. 9*c* represents the sensor module without the bend stiffener;

FIG. 10 is a section in an axial plane through a bend stiffener embodying the present invention carrying a sensor module;

FIG. 11*a* is a section in an axial plane through a bend stiffener and a sprung clamp embodying the present invention, the clamp being in an open configuration; FIG. 11*b* is similar to FIG. 11*a* but shows the sprung clamp in a closed configuration; FIG. 11*c* represents the same assembly viewed from one side;

Figure 14A:
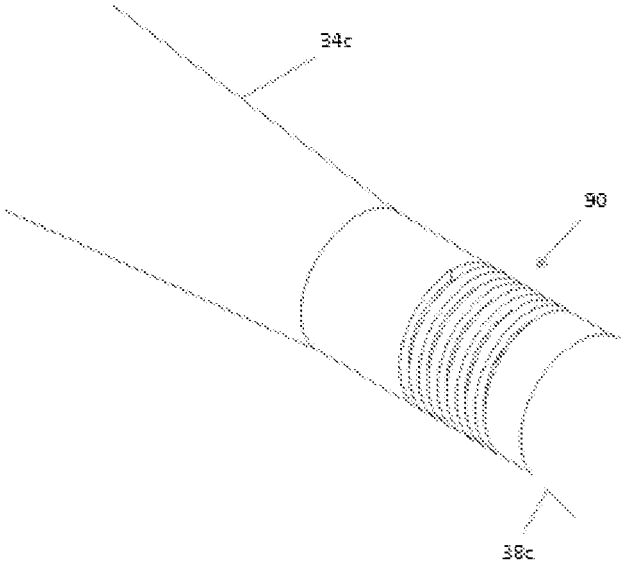
Figure 14B:
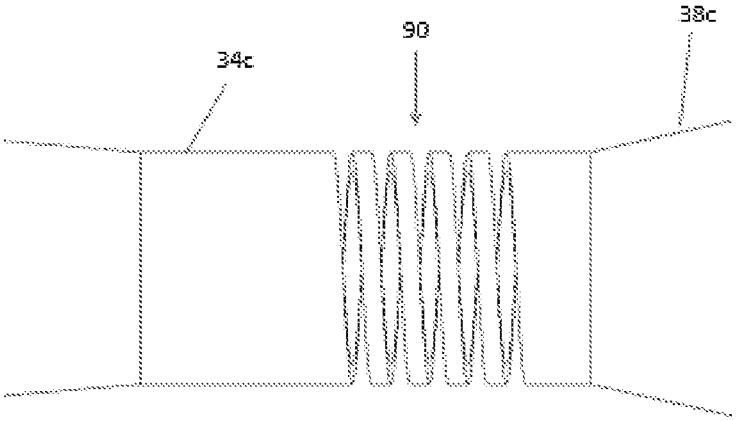
Figure 15:
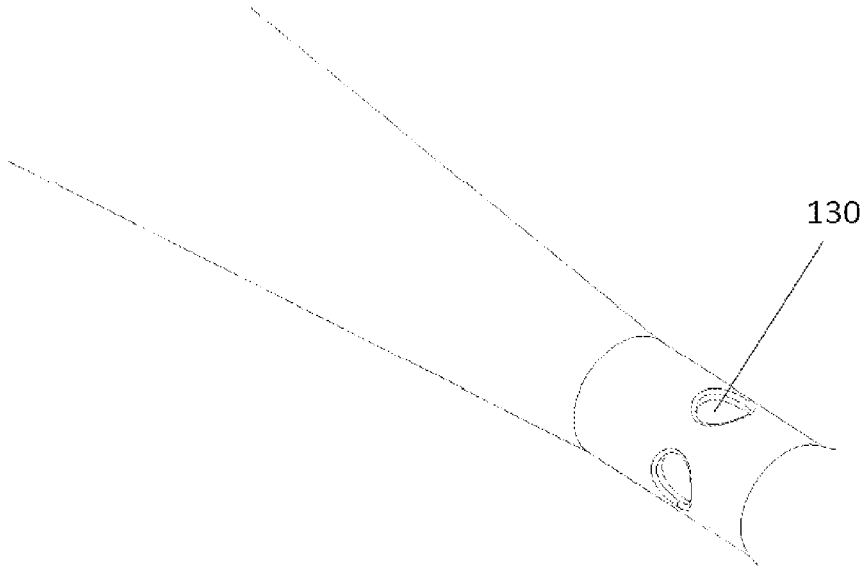
Figure 16:
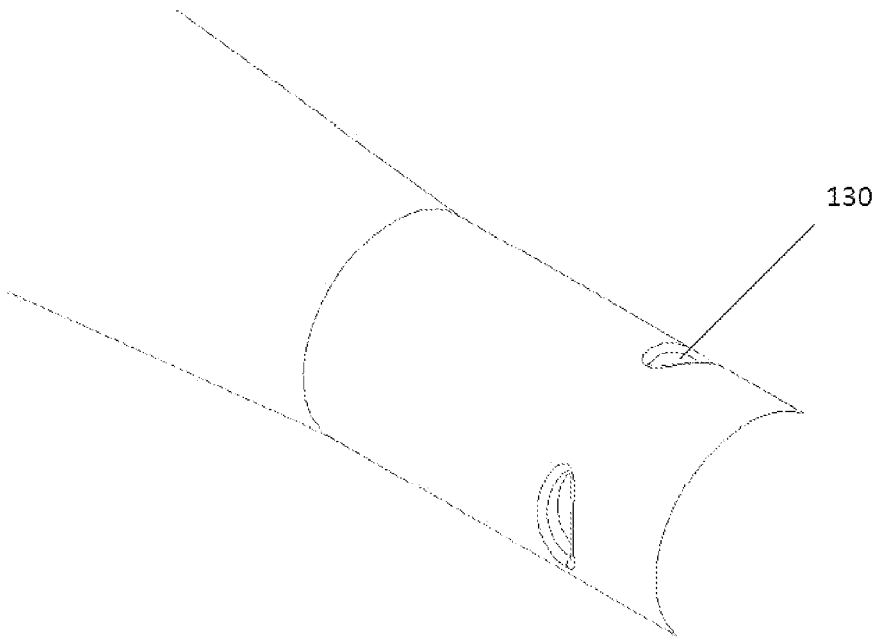
Figure 17:
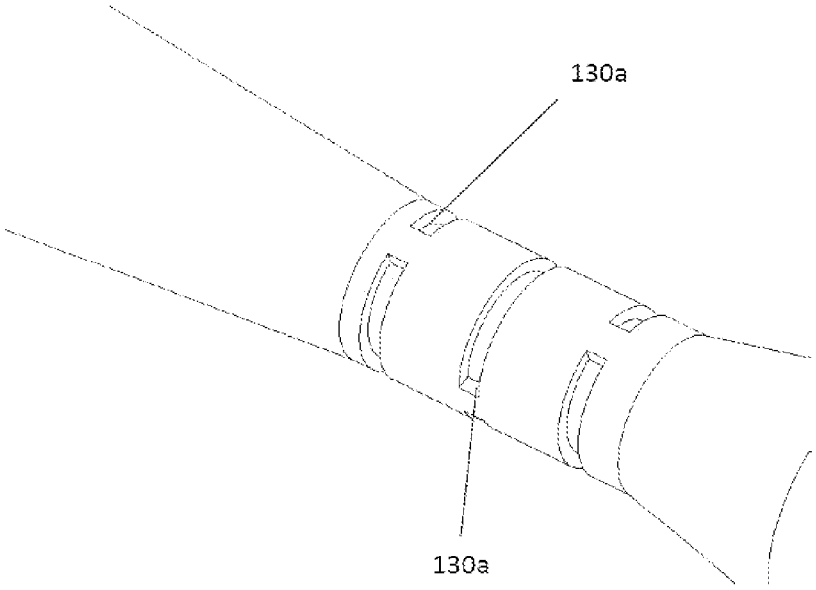
Figure 18A:
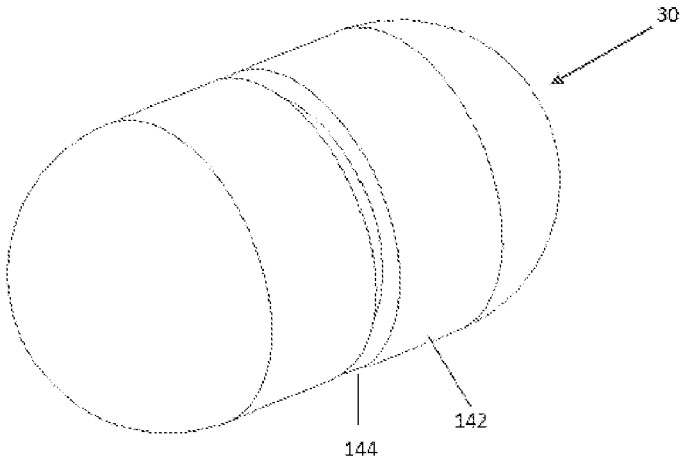
Figure 18B:
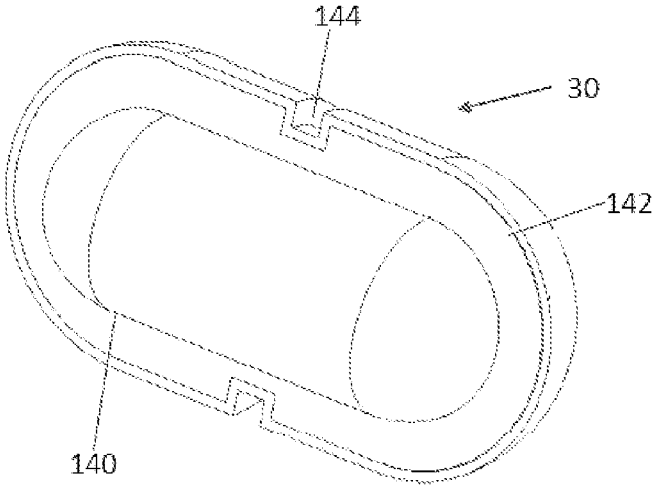
Figure 19:
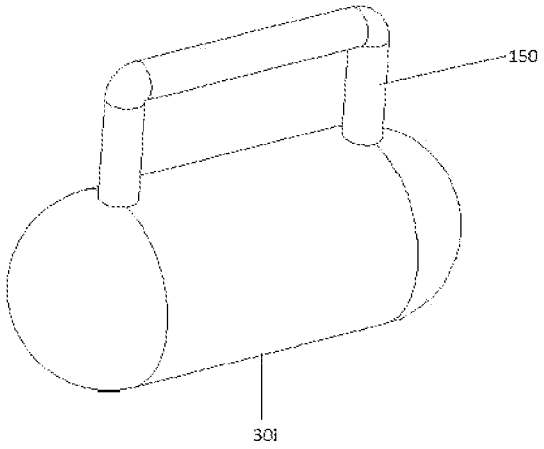
Figure 20:
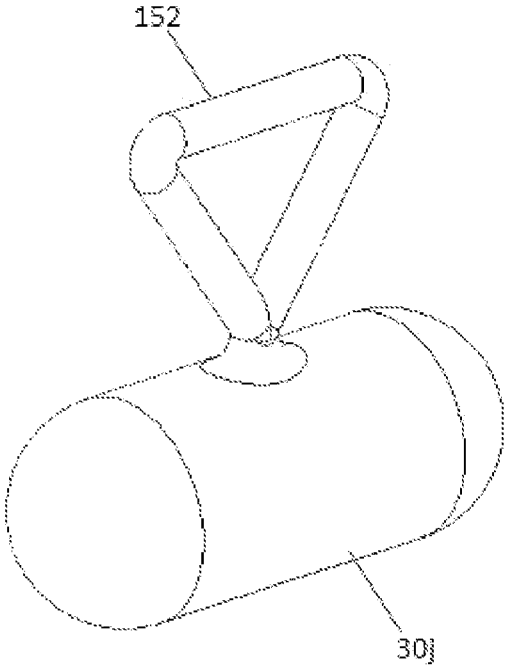

FIGS. 14*a* and 14*b* represent yet a further bend stiffener embodying the present invention;

FIG. 15 represents still a further bend stiffener embodying the present invention;

FIG. 16 represents yet a further bend stiffener embodying the present invention;

FIG. 17 represents another bend stiffener embodying the present invention;

FIGS. 18*a* and 18*b* are side and partly sectional representations respectively of a sensor module embodying the present invention;

FIG. 19 represents a further sensor module embodying the present invention; and FIG. 20 represents still a further sensor module embodying the present invention.

Figure 2A:
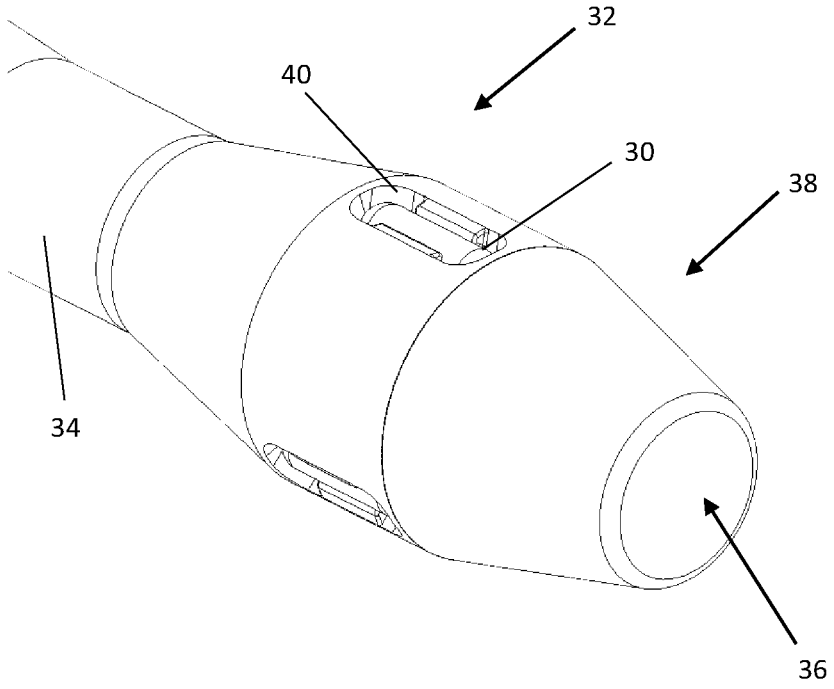
Figure 2B:
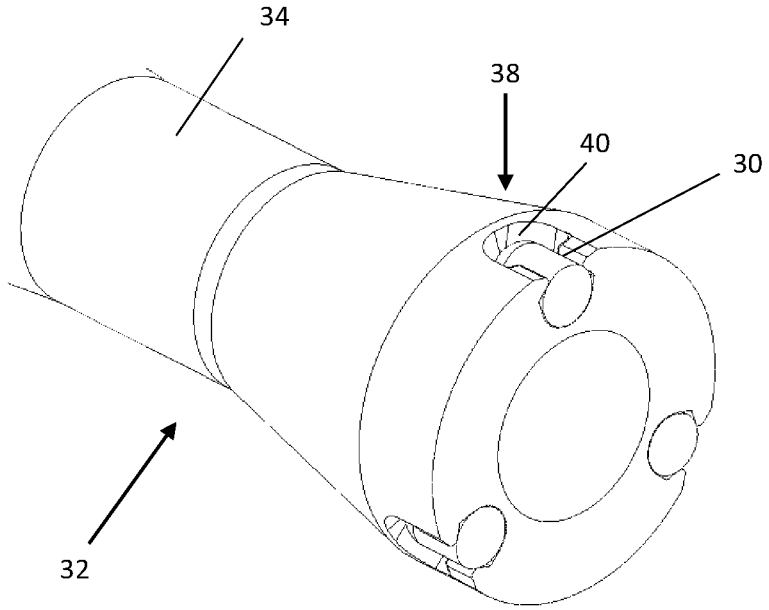

FIGS. 2*a* and 2*b* illustrate a first embodiment of the present invention, which has a sensor module 30 carried by a bulbous tip portion 38 of a bend stiffener 32.

Figure 1:
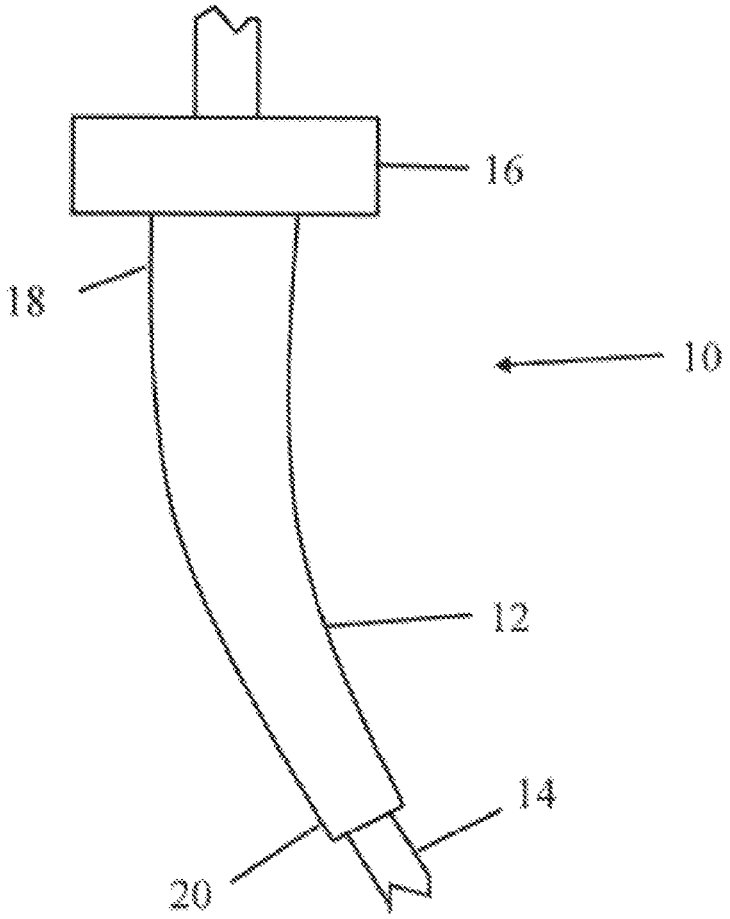

The bend stiffener 32 can be of any type suited to the particular application. It may, like the example depicted in FIG. 1, have steelwork 16 or some other form of coupling at its root end to couple to a termination structure which may for example be an "I" tube or a "J" tube, or could take any other suitable form. The steelwork could for example be the type of ball-and-ramp type coupling disclosed in WO2017/093725, Trelleborg Offshore UK Ltd., (the content of which is hereby incorporated by reference) for mounting a bend stiffener in the leg of a wind turbine. In this context the elongate flexible underwater member being protected is the electrical cable used for power transmission. The bend stiffener 32 comprises a flexible stiffener body 34 which in this example comprises moulded elastomer. Polyurethane is one suitable material although others may be used. The stiffener body 34 is shaped to receive and embrace an elongate flexible underwater member and to protect it from over-bending. In this example it has for this purpose a through-going axial passage 36 of circular cross section. The stiffener body 34 of the present example is of unitary construction, so that the member being protected must be passed through the passage 36 to mount the bend stiffener 32. Other constructions are however possible. For example, some known bend stiffeners are split along their length to enable the member to be introduced laterally. While a unitary construction is attractive in terms of fatigue lifetime and avoidance of localised stress concentration, the stiffener body 34 may in some instances be formed from two half shells for assembly around the elongate member. Although the drawings show only part of the stiffener body 34, this component is in the present example of generally frusto-conical shape (similarly to the example in FIG. 1) tapering from a relatively wide root end to a narrower tip end, to provide a desired bending profile which avoids concentration of bending load on the elongate member where it emerges from the stiffener body 34. Other profiles may be used in other embodiments.

In accordance with an aspect of the present invention, the profile of the stiffener body 34 includes the bulbous tip portion 38 which accommodates the sensor module 30.

The sensor module 30 of the present embodiment is a self-contained unit having an onboard power supply. It has an outer housing which is sealable against ingress of water. In the present embodiment it is removably mounted to the stiffener body 34. In the present embodiment it is accessible from the exterior of the stiffener body 34. The sensor module 30 may be mounted in a manner which enables it to be conveniently detached from the bend stiffener by means of a remotely operated vehicle. A range of different arrangements for mounting the sensor module to the stiffener body 34 will be discussed below.

The sensor module 30 of the FIG. 2 embodiment has a housing in the form of a cylinder with hemispherical ends, which is a shape well suited to withstanding hydrostatic pressure. In the case of mid-line bend stiffeners, the sensor module 30 may experience significant pressure. The sensor module 30 may thus constitute a pressure vessel, maintaining internal pressure around a chosen level (e.g. atmospheric) despite external hydrostatic pressure.

The sensor module 30 can take other shapes. It could have flat ends in place of the hemispherical ends depicted. It may take the form of a half shell or part-shell extending circumferentially about the stiffener body, which can provide a large volume for battery carrying without excess radial projection.

The sensor module 30 comprises sensors for monitoring orientation and/or motion of the stiffener body 34 and hence of the elongate member within it. These may take any suitable form but in the present embodiment the sensor module 30 comprises in particular a sensor or sensor array (not shown) which is responsive to the orientation of the sensor module 30 with respect to gravity, so that the inclination of the sensor module 30 is able to be monitored. Suitable sensor devices are very well known. The present embodiment uses a nine axis motion tracking sensor arrangement comprising a three axis magnetometer, a three axis accelerometer, and a three axis gyroscope. These are implemented using MEMS (micro electro mechanical) technology on a silicon die. Suitable devices are well known and widely available. Other motion or orientation or position sensing technologies may be substituted in other embodiments.

By sensing the inclination and/or the orientation and/or movement of the tip portion 38 of the stiffener body 34, the sensor module 30 makes it possible to determine the degree of bending of the stiffener body 34 and of the elongate member that it houses.

Other sensors may be incorporated into the sensor module 30. These may be to monitor additional aspects of the working environment of the bend stiffener 32 and the elongate member. One or more temperature sensors may be included.

The sensor module 30 is, according to the present embodiment, configured to log sensor data for subsequent retrieval. For this purpose it includes a microprocessor and memory (not shown in the drawings). A degree of processing of the sensor output may be carried out in the sensor module 30, e.g. to compress the data or select from it sufficiently to allow sensor data from a protracted period (which may be months or years) to be stored in the memory.

Provision is made for sensor data from the sensor module 30 to be retrieved for processing in a remote system. The sensor module 30 provides a data interface for this purpose. Data retrieval may involve physical retrieval of the sensor module 30, whose stored sensor data can then be read from it. This may be carried out using a remotely operated vehicle. Additionally or alternatively the sensor module's data interface may comprise an arrangement for transmission of data to a receiver without a wired connection. This may be suited to transmission of the data to a receiver carried by a remotely operated vehicle or diver, so that data can be retrieved on inspection visits to the installation. The interface in question may:—

- provide a suitably modulated optical output, transmitted through the surrounding water. Suitable optical communication systems are known and are commercially available;
- provide an acoustic output transmitted to the receiver by the water. Suitable underwater acoustic modems are known in the art; and/or
- employ a suitable radio link, which may be a low frequency radio where the sensor module is submerged, or in cases where the sensor module is above the water in the splash zone it could employ a more conventional radio communications protocol such as RFID, Bluetooth® etc.

In such cases data retrieval will in some instances be possible without physical removal of the sensor module 30 from the bend stiffener.

An additional or alternative data interface may be provided for exchanging data with the sensor module 30 at the surface, especially prior to its deployment or following its retrieval, and may for example use a radio protocol e.g. Bluetooth®, or a wired connection accessible by opening the module's housing.

The data retrieved from the sensor module 30 is able to be used in various ways. It can be used to assess the history and condition of the elongate member and/or the bend stiffener 32. The data may for example be used in determining when these components need to be renewed, retired, or subject to remedial action. Such assessment may take account of cumulative instances of bending, impinging on fatigue lifetime, and/or of individual instances of over-bending, which might in themselves be a reason for renewal or for remedial action to be taken. The sensor data can be used to inform the design process in relation to future installations. It may for example be used to validate modelling used in the design process, by determining e.g. whether the range and frequency of motion experienced in the real world match the model. Confidence in design models thus obtained can make it possible to be less conservative in designing subsequent installations.

The sensor data may be used to inform decisions about life extension of components including the riser itself. An operator might wish to extend the working lifetime of an installation beyond what was originally intended and planned for, and the commercial advantages in doing so may be very large. The reality may be that a given riser has suffered only light stress during its working lifetime and can safely remain in service, and the sensor data can be used to make this determination, so that this planning need not be carried out on an unnecessarily conservative basis.

The sensor module 30 is according to the present embodiment provided with an onboard battery to power the sensors and associated microprocessor and memory. This may be selected to give a protracted battery lifetime of months or years, in order to avoid the expense involved in frequent battery renewal.

In some embodiments the sensor module 30 is configured to harvest energy from its environment to extend battery lifetime. This energy may be thermal (in the case of installation on an oil riser, there is typically a pronounced difference between the temperature of the riser and that of the surrounding water which can be exploited for harvesting of energy) or kinetic (the sensor module 30 moves and the resultant kinetic energy can be harvested e.g. through a tribo-electric generator). A range of devices suitable for harvesting energy is known in the art and details are not provided herein.

Mounting the sensor module 30 in the bend stiffener (rather than in some separate mounting device additional to the bend stiffener) means that deploying the sensor module 30 does not involve any additional process or complexity during deployment.

The sensor module 30 is mounted in tip portion 38 of the stiffener body 34. This is advantageous. Positioning the sensor module 30 at the tip of the stiffener body 34 means that it experiences the widest range of movement and of changes in inclination (since the tip of the stiffener body 34 moves and turns more than its root). Positioning the sensor module 30 in the tip portion of the stiffener body 34 may also avoid the risk that its incorporation might compromise the fatigue characteristics of the stiffener body 34, since in some bend stiffeners the tip portion is not required to sustain significant bending loads.

In the embodiment illustrated in FIGS. 2*a* and 2*b*, the stiffener body 34 is shaped to provide at its free end (its tip) the aforementioned enlarged or bulbous tip portion 38, which accommodates the sensor module 30. In fact this embodiment uses not one sensor module 30 but three of them, at circumferential intervals around the stiffener body 34. Multiple units may provide redundancy. Alternatively or additionally, each may be activated for a different period of time, to prolong battery life of the installation as a whole. For example if the batteries fitted to each sensor module 30 are able to provide one year of active data logging then a first module may be active for a first year, a second module may be active for a second year (being activated at the end of the first year e.g. by a timer, or by a low battery signal from the first module), and a third module (similarly activated at the end of the second year) can log data through the third year. In this way the installation as a whole is able to log data through a three year cycle, perhaps between inspection visits at a similar interval of time by a remotely operated vehicle (ROV).

Figure 2C:
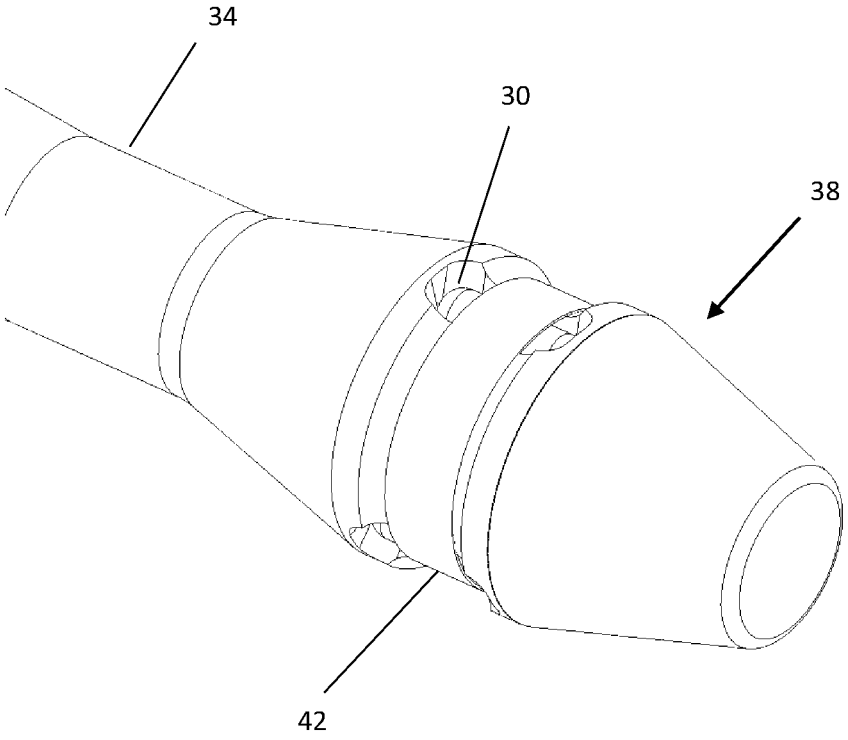

The sensor modules 30 are received in respective radially outwardly open recesses 40 formed in the tip portion 38. In this embodiment the sensor modules 30 form a snap fit in their recesses 40, which are of part-circular section and somewhat undercut. A suitable tool carried by an ROV may be used to pop the sensor modules out of their recesses for recovery. A variant is represented in FIG. 2*c*, where in place of the snap fit configuration the sensor modules 30 are retained in their respective recesses by means of a strap 42 placed around them. In either case the sensor modules 30 are securely retained but are nonetheless straightforwardly recoverable using an ROV.

Figure 3A:
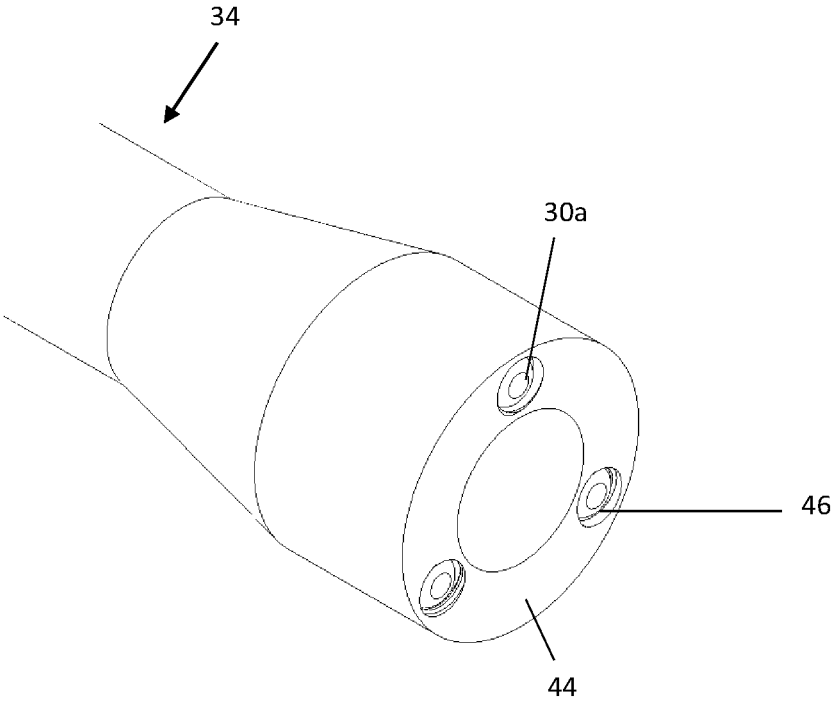
Figure 3B:
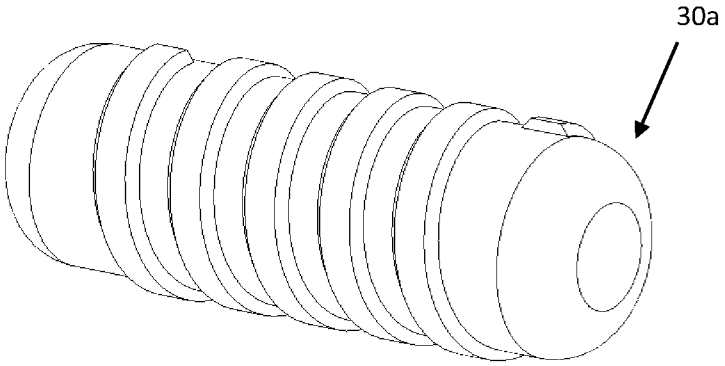

An alternative mode of mounting is represented in FIG. 3, where the sensor modules 30*a* are provided with a coarse screw thread on their exterior, and an end face 44 of the stiffener body 34*a* has complementary internally threaded recesses 46, so that the sensor modules 30*a* are able to be screwed into the stiffener body 34 and subsequently unscrewed from it for removal. In further embodiments the sensor modules may be received in radially facing recesses of the stiffener body 34.

Figure 4:
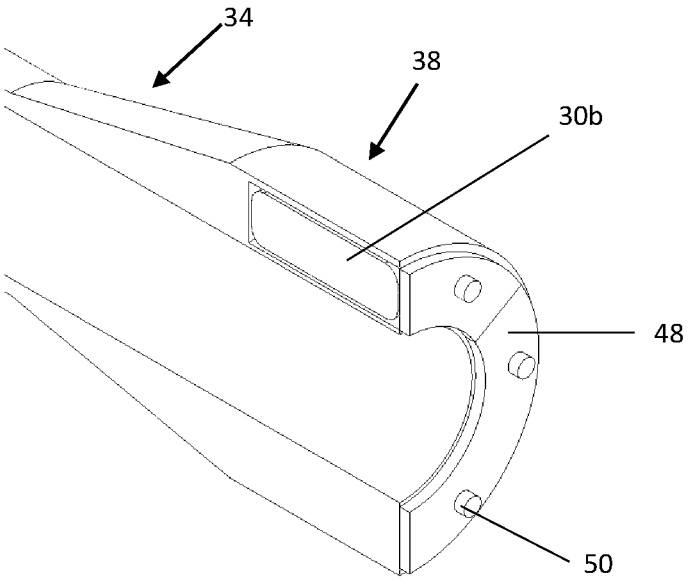

FIG. 4 illustrates an embodiment in which the sensor modules 30*b* are received in recesses in the end face of the stiffener body 34 and are retained therein by a removable cover 48. In this example a single cover 48 of annular shape covers all of the recesses and is secured using threaded fasteners 50.

Figure 5A:
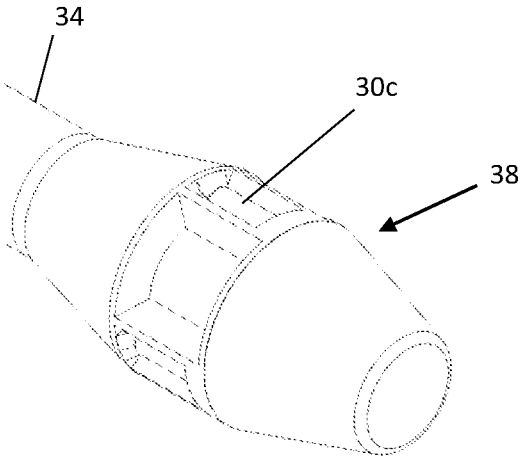
Figure 5B:
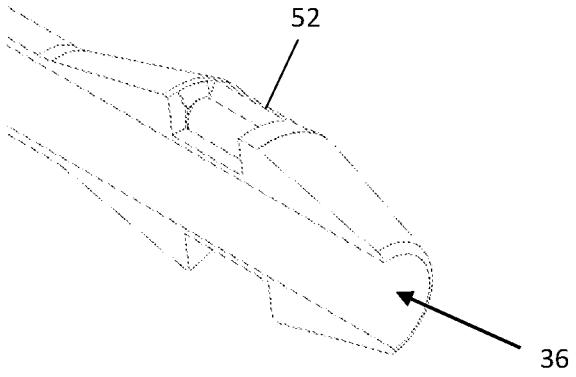
Figure 5C:
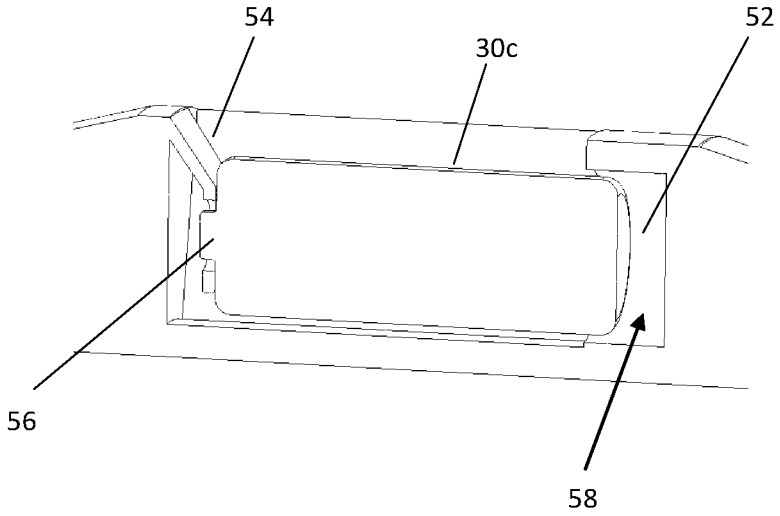

The sensor module(s) may be removably retained on the stiffener body 34 through a spring clip arrangement. FIG. 5 provides an example in which the tip portion 38 of the stiffener body 34 has radially outwardly facing recesses 52 to receive respective sensor modules 30*c*, each recess having a resilient spring clip 54 which is somewhat deformed upon insertion of the sensor module 30*c* and springs back to engage and retain it. In this example a pip 56 is formed on one end the sensor module 30*c* to engage the spring clip. The other end of the sensor module 30*c* is received in a shallow bore 58 and so retained. The spring clip 54 can be pushed back to disengage it from the pip 56 and enable removal of the sensor module 30*c*. This operation can be carried out using a tool of an ROV.

Figure 6A:
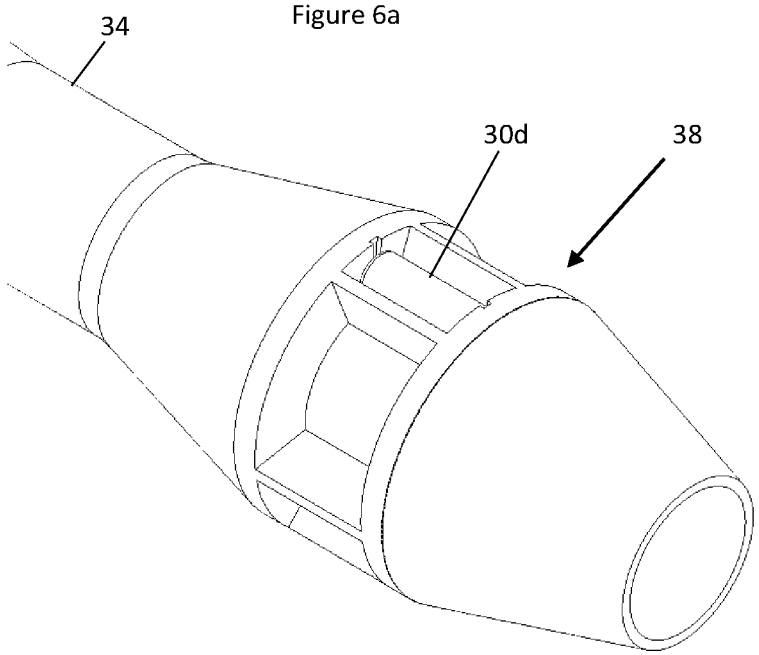
Figure 6B:
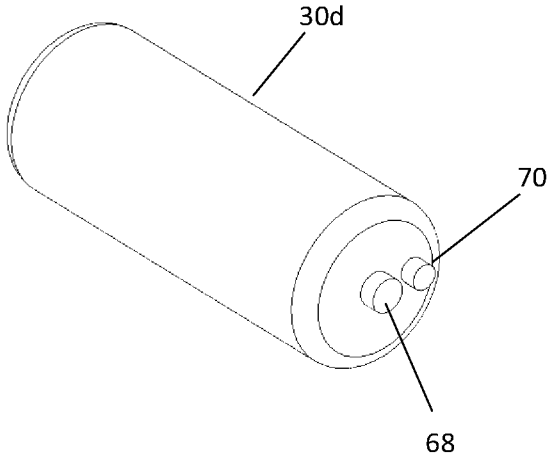
Figure 6C:
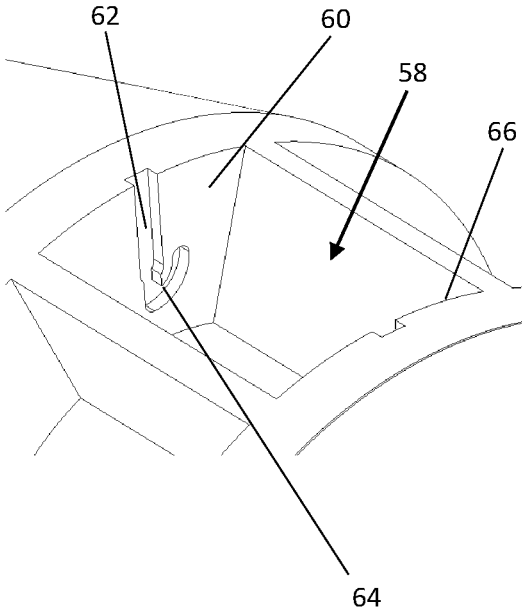

The sensor module(s) may be removably retained on the stiffener body 34 through a part-turn lock. FIG. 6 provides an example in which a recess 58 has an internal face 60 incorporating a shaped locking channel 62 with a curved return 64. Opposed face 66 of the recess 58 is similarly formed, although only the end of its locking channel is seen in the drawings. End faces of the corresponding sensor module 30*d* each have in this example a pair of followers 68, 70, one lying on the axis of the cylindrical sensor module 30*d* and one offset from it. To insert the sensor module 30*d* into the recess, the followers 68, 70 are received in the locking channels 62. When the module 30*d* is fully inserted, it is able to be turned, causing the offset follower 70 to move along the return 64 to lock the sensor module 30*d* in place. To unlock and remove the sensor module 30*d* it must first be turned in the reverse direction. Inadvertent turning and release of the module may be resisted by offsetting its centre of gravity from its axis and/or (if the module is not a plain cylinder) by offsetting its centre of buoyancy from its axis.

Figure 7A:
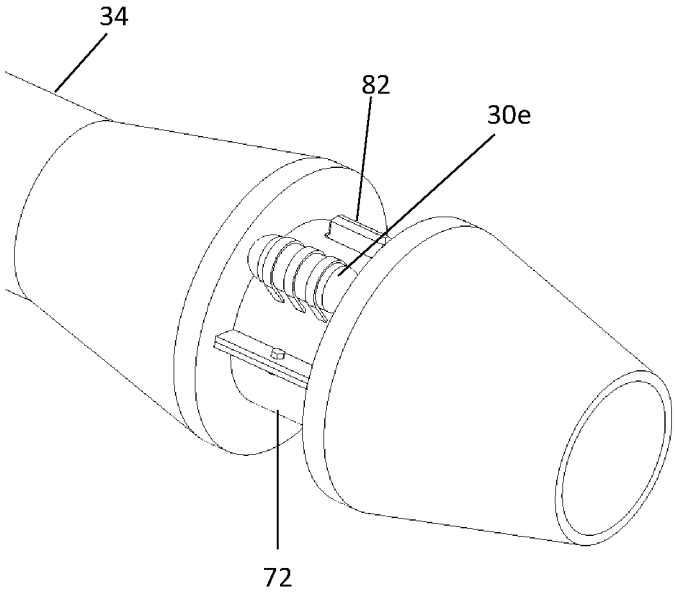
Figure 7B:
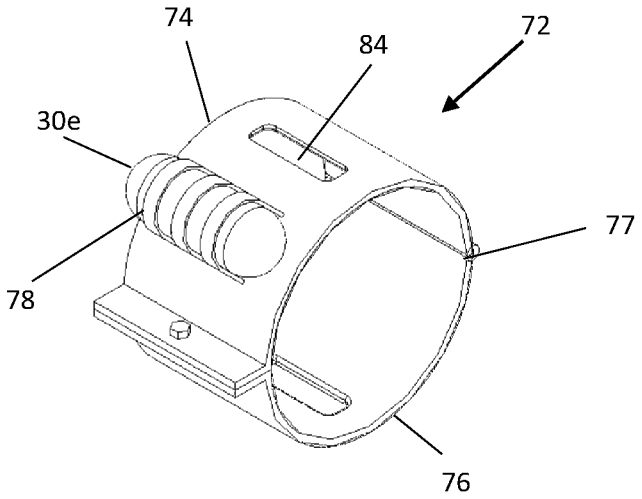
Figure 7C:
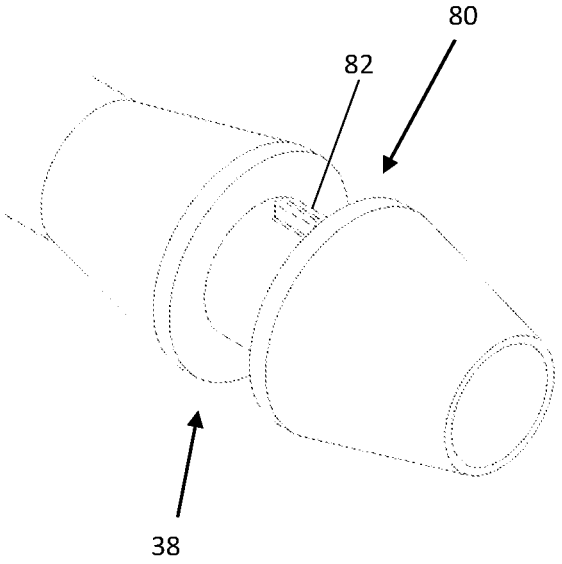

The sensor module(s) may be secured to the stiffener body 34 through an intermediate part, rather than engaging directly with the material of the stiffener body 34. The intermediate part may comprise a strap or clamp around the stiffener body 34. FIG. 7 provides an example comprising a clamp 72 formed from two semi-circular clamp shells 74, 76 coupled through a hinge arrangement 77. The exterior of one of the clamp shells 74 carries a single sensor module 30*e* using an arrangement of hoops 78. In this example the tip portion 38 of the stiffener body 34*e* has a reduced diameter portion 80 to axially locate the clamp 72, and rotation of the clamp 72 is prevented by tongues 82 formed on the stiffener body 34 received in complementary openings 84 of the clamp 72.

Figure 8A:
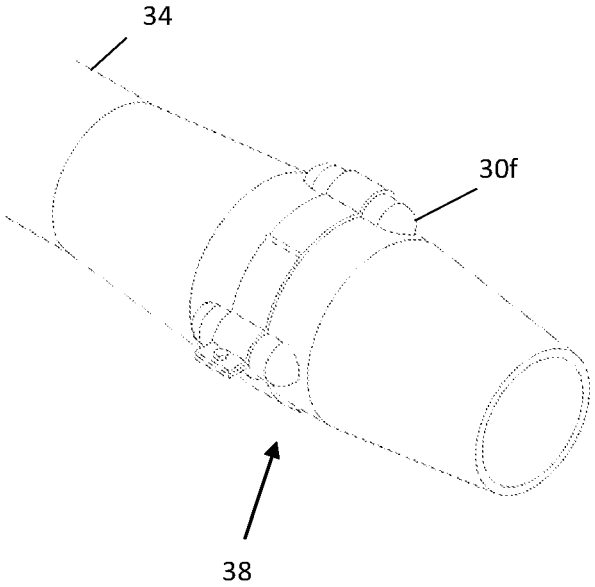
Figure 8B:
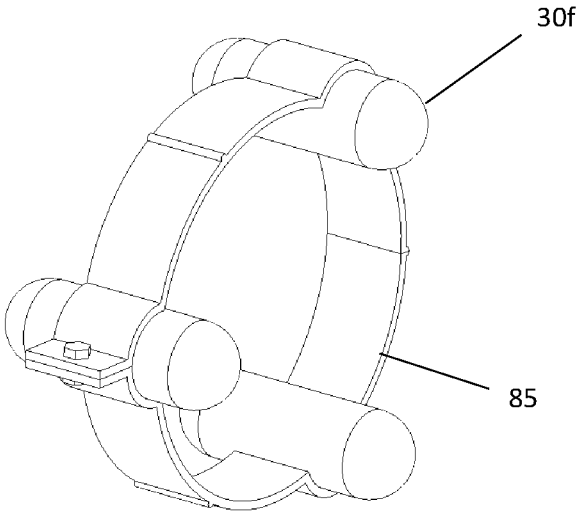
Figure 8C:
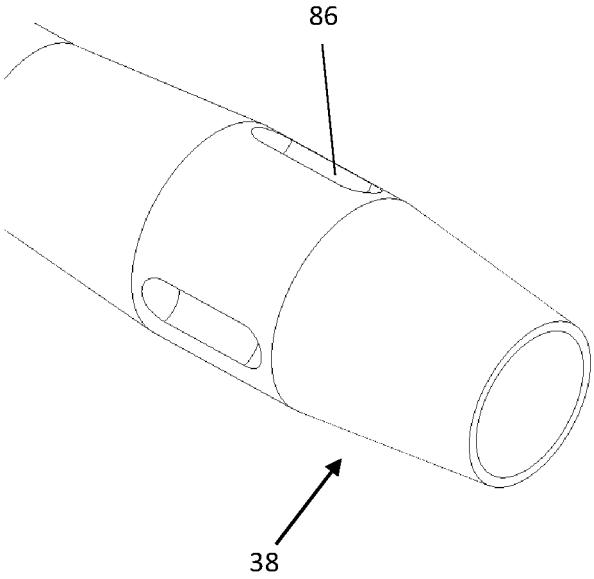

FIG. 8 represents another embodiment in which sensor modules 30*f* are carried on a form of ring clamp. In this example there are three clamp shells 85 hingedly coupled together and each shaped to encircle a respective sensor module 30*f*, these modules being received in respective radially outwardly open recesses 86 in the exterior of the stiffener body 34*f*. The sensor modules 30*f* are secured to the clamp so that they can be retrieved as a single unit, without the risk that individual modules might be lost during retrieval.

Figure 9A:
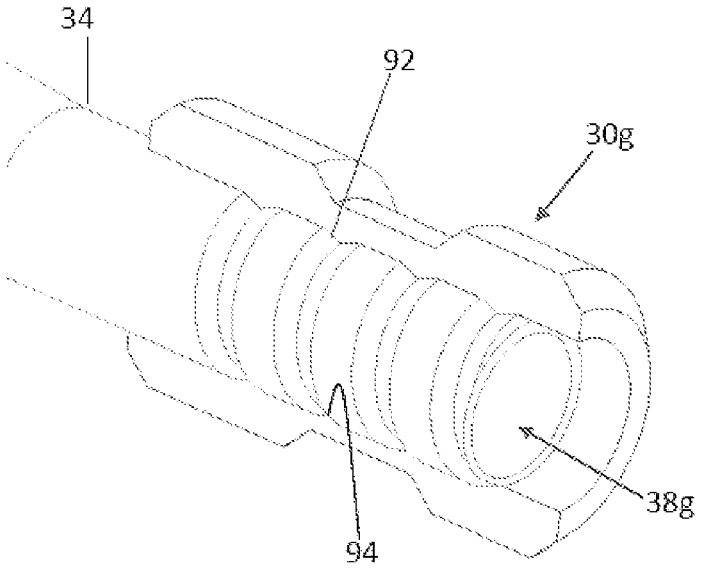
Figure 9B:
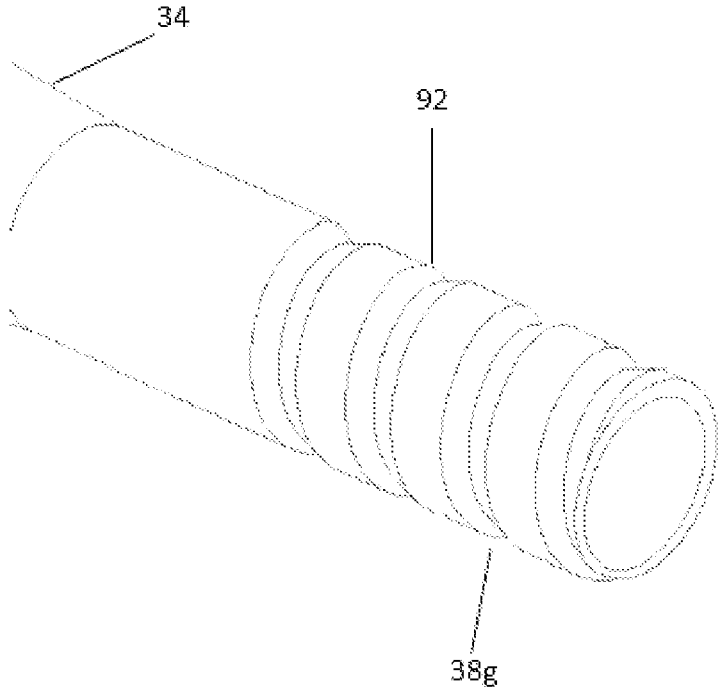
Figure 9C:
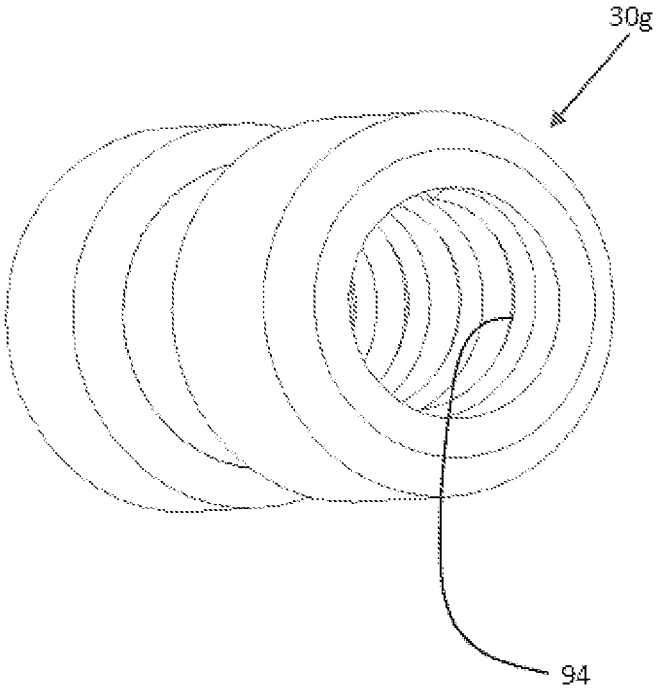

The sensor module may be configured to threadedly engage with the stiffener body. FIG. 9 provides an example in which the outer surface of the tip portion 38*g* of the stiffener body 34 is formed with a helical groove 92 forming a large and coarse external screw thread on the stiffener body itself. The sensor module 30*g* in this example is of tubular form and has a helical groove 94 on its inner surface, forming a similarly large and coarse internal thread. Mounting of the sensor module 30*g* thus involves advancing it onto the stiffener body and suitably aligning it to engage the threads, then turning the sensor module 30*g* to screw it into place. Removal involves turning the sensor module 30*g* in the opposite direction. These processes can be carried out by an ROV.

The sensor module may be housed in or comprise a covering of material which is relatively soft in comparison with that of the stiffener body 34. The material of the covering may be an elastomer. It may be a polymeric elastomer. It can have an elastic modulus which is small in relation to that of the material of the stiffener body 34. This can ensure that the addition of the sensor module does not unacceptably change the mechanical properties (bend stiffness, fatigue lifetime etc.) of the stiffener body 34 itself.

A covering or housing for the sensor module may be formed on the stiffener body 34 by overmoulding. This may be carried out subsequent to moulding of the main part of the stiffener body 34. Overmoulding is advantageous in that (a) in certain embodiments it enables the covering or housing for the sensor module to be formed from a material different from that of the stiffener body 34 itself (the housing or covering may be relatively soft, as explained immediately above); (b) it avoids complication of the moulding of the main part of the stiffener body 34 and possible compromise of the body's mechanical properties; and (c) in the event of a failure in moulding of the relatively complex parts covering or housing the sensor module, these parts can be removed and the overmoulding process can be repeated, without any need to scrap the main part of the stiffener body 34, which is an expensive item to manufacture.

Figure 10:
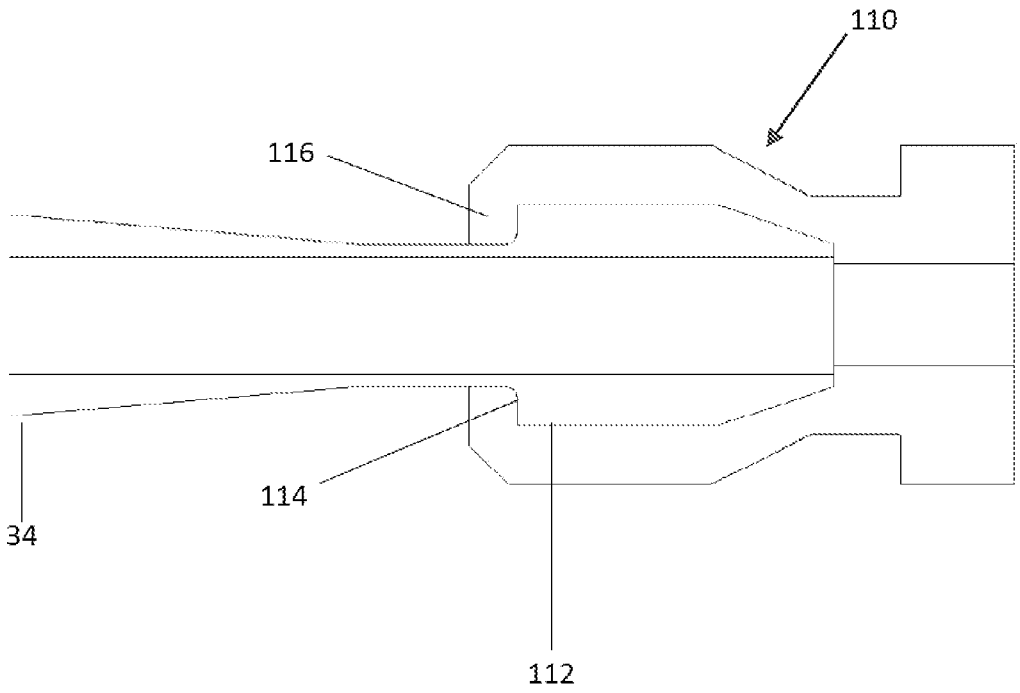

In the embodiment illustrated in FIG. 10, the sensor module comprises or is carried by a cap 110 mounted over the free end of the stiffener body 34. The cap 110 may be formed in situ by overmoulding. Alternatively it may be a snap fit onto and off the stiffener body 34. The stiffener body 34 in this embodiment is formed with an enlarged head 112 with a shoulder 114. The cap 110 is of circular section and has a radially inwardly directed return 116 engageable with the shoulder 114 to retain the cap 110 in place. If the cap is a snap fit, its material is sufficiently pliable to permit the return 116 to pass over the head 112.

Figure 11A:
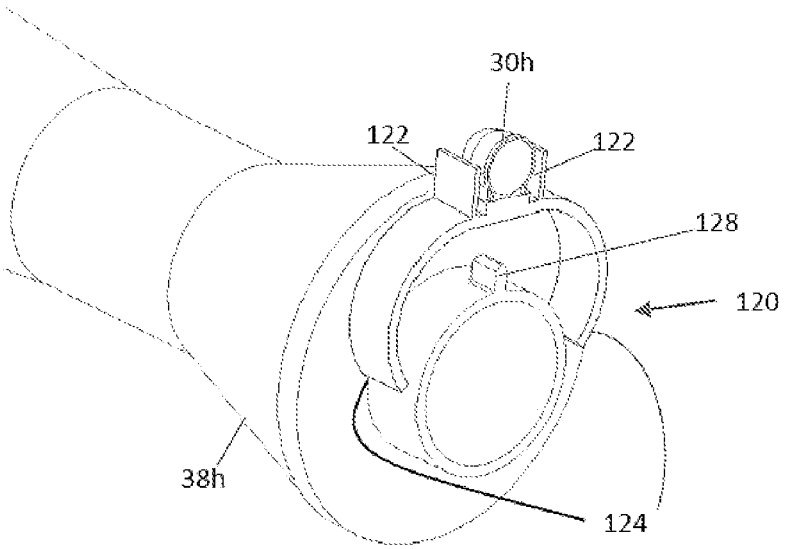
Figure 11B:
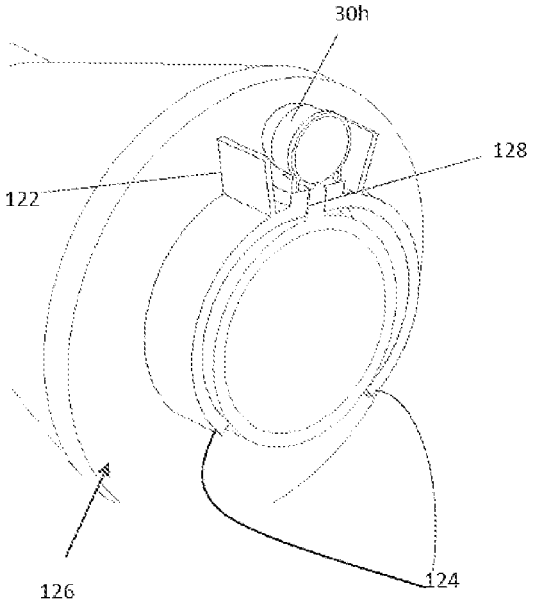
Figure 11C:
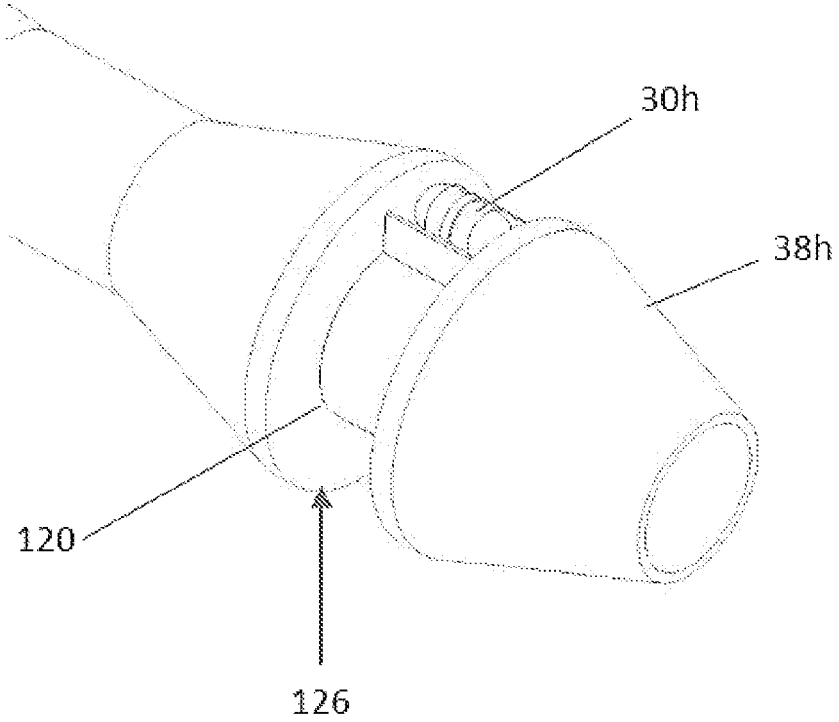

A sprung clamp may be used to mount the sensor module. The tip portion of the stiffener body 34 may be shaped to locate the sprung clamp. This can make it unnecessary for the clamp to be tightened excessively against the stiffener body. FIG. 11 represents a sprung clamp 120 which may be used to carry the sensor module 30*h* and to facilitate its removal and retrieval using an ROV. In this embodiment the sprung clamp 120 is part-circular in shape and has a pair of radially outwardly projecting tabs or lugs 122. Pushing the lugs 122 together causes material between them to flex and "C" shaped portions 124 of the clamp on either side of the lugs 122 to move apart, opening the clamp and enabling it to be fitted to the stiffener body 34. Releasing the lugs 122 allows the clamp 120 to close around the stiffener body 34, securing itself in place. The sensor module 30*h* is carried by the clamp 120, being disposed between the lugs 122 in the present embodiment. The tip portion 38*h* of the stiffener body has a circumferential recess 126 in which the clamp 120 is received, to locate the clamp 120 axially. It also has an upstand or tongue 128 which is received in a complementary recess or opening of the clamp 120 (FIG. 11*b*) to locate the clamp 120 rotationally.

Some bend stiffeners (including those whose design is referred to in the art as "base-driven") are relatively flexible and lightly stressed at their tip, so that incorporation of the sensor module 30 proximate the tip does not significantly compromise the stiffener's characteristics or its fatigue lifetime. Some bend stiffeners (including those whose design is referred to in the art as "tip driven") are formed to sustain higher stresses at the tip.

It may be undesirable to subject the tip portion of the stiffener body which carries to the sensor module to bending stresses. To alleviate any such problems, the tip portion 38 may be coupled to the remainder of the stiffener body 34 through a flexible neck so that the tip portion 38 is relatively free to change its inclination along with the elongate member within, without being subject to the bending loads carried by the remainder of the stiffener body. In these embodiments the tip portion 38 is effectively isolated from and relieved of the bending moments sustained by the remainder of the stiffener body 34.

Figure 12:
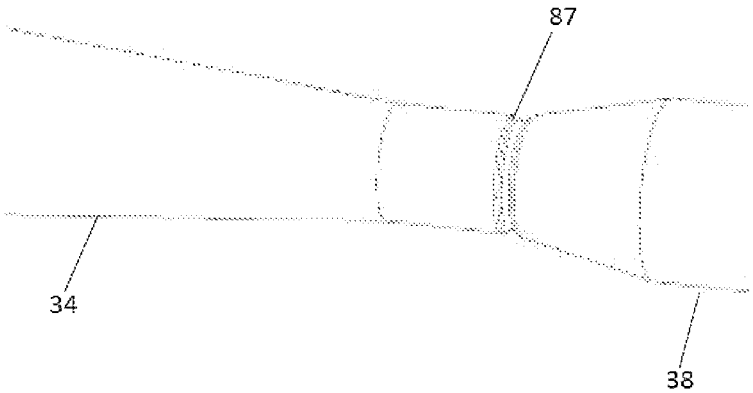
FIG. 12 represents a further bend stiffener embodying the present invention.

FIG. 12 represents one such embodiment in which a circumferential groove 87 is provided between the tip portion 38 and the remainder 34 of the stiffener body, forming a type of live hinge which segregates the two parts.

Figure 13:
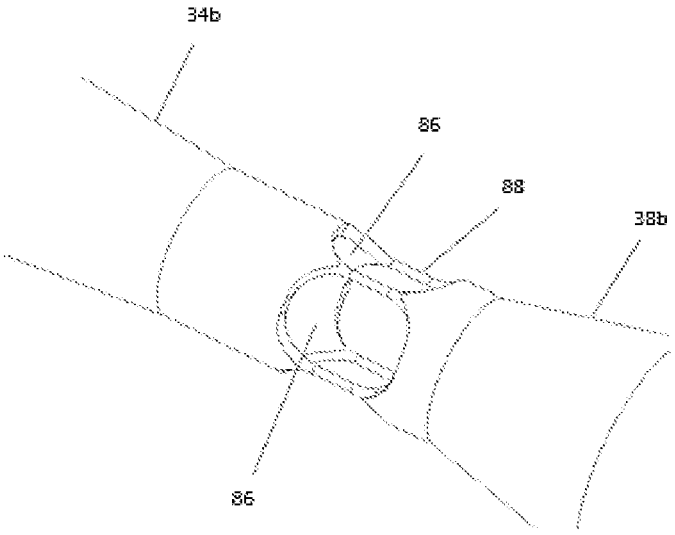
FIG. 13 represents still a further bend stiffener embodying the present invention.

FIG. 13 represents another such embodiment in which cut-aways 86 form a flexible neck region between the tip portion 38*b* and the remainder 34*b* of the stiffener body, this region being bridged by arms 88 between the cut-aways.

FIG. 14 represents still another such embodiment in which the tip portion 38*c* is coupled to the remainder 34*c* of the stiffener body through a helical formation 90 forming the flexible neck.

Cut-aways 130 to render the neck portion sufficiently flexible may be of any suitable shape and may for example be round (FIG. 15), oval or elliptical (FIG. 16), or may take the form of circumferentially extending slots—see FIG. 17, where the slots 130*a* in question are axially and circumferentially spaced along the neck portion.

The sensor module 30 may comprise a sealable pressure vessel with an external jacket. The jacket may serve to protect the pressure vessel from damage by impacts. It may carry features through which the sensor module is mountable to the stiffener body. Long term integrity of the pressure vessel may be improved by using the jacket to isolate the pressure vessel from the means used to mount it. FIG. 18 provides an example. The pressure vessel is item 140 and is surrounded by the jacket 142. A circumferential recess 144 in the jacket facilitates its mounting, in this example.

The pressure vessel may be provided with a handle or other feature configured to be grasped by a manipulator or tool carried by an ROV. FIGS. 19 and 20 provide examples. In FIG. 19 the sensor module 30*i* carries an "n" shaped upstanding handle 150 and in FIG. 20 the sensor module 30*j* carries a triangular handle 152.

The aforegoing embodiments are presented by way of example and not limitation. The invention may be put into practice in a range of different ways. For example the sensor module 30 need not in certain embodiments be detachable from the stiffener body. It may instead be incorporated into the stiffener body. The sensor module 30 may be attached to the stiffener body with some suitable form of fastener, such as a threaded fastener. Sensor modules permanently mounted to the stiffener body may be configured to harvest energy as described above in order to provide a sufficient working lifetime.

Whereas the bend stiffeners described above are mounted at a point where the elongate member enters a supporting structure, the invention may be implemented in relation to mid-line bend stiffeners.

Bend stiffeners bodies are in some installations coupled to one another, as depicted and described for example in WO2017/093725 (application PCT/GB2016/053758, applicant Trelleborg Offshore UK Ltd). The present invention may be implemented in relation to the stiffeners bodies of this type of bend stiffener, the sensor module typically (but not exclusively) being fitted to a tip portion of the last bend stiffener body in the assembly.

The invention claimed is:

1. A bend stiffener for locally protecting an elongate flexible member from excessive curvature when the elongate flexible member is deployed in water, the bend stiffener comprising:

an elongate stiffener body having
- a root end,
- a free end, and
- a passage extending through the stiffener body from the root end to the free end for receiving and embracing the flexible member;

a coupling at or toward the root end of the stiffener body for mounting the stiffener body; and a sensor module located proximate the free end of the bend stiffener, the sensor module being a self-contained device with a sealable housing containing
- sensors configured to sense inclination and/or orientation and/or movement of the free end of the bend stiffener,
- an onboard power supply, and
- a memory for logging sensor data, and wherein the sensor module being removably mounted to the stiffener body enabling the sensor module to be recovered while the bend stiffener is deployed; and the stiffener body being sufficiently flexible to curve along with the flexible member when the flexible member suffers a bending load.

2. The bend stiffener as claimed in claim 1, wherein the stiffener body tapers inwardly from its root toward its free end but comprises an enlarged tip portion carrying the sensor module.

3. The bend stiffener as claimed in claim 1, wherein the sensor module comprises any one of an accelerometer, an inclinometer and a gyroscopic sensor.

4. The bend stiffener as claimed in claim 1, wherein the sensor module comprises a three-axis accelerometer.

5. The bend stiffener as claimed in claim 1, wherein the stiffener body has a recess which faces radially outwardly with respect to an axis extending along the length of the stiffener body and which receives the sensor module.

6. The bend stiffener as claimed in claim 5, wherein the sensor module is a snap fit in the recess.

7. The bend stiffener as claimed in claim 5, wherein a resilient spring clip is provided to retain the sensor module in the recess.

8. The bend stiffener as claimed in claim 5, wherein a part turn lock configuration is provided to retain the sensor module in the recess.

9. The bend stiffener as claimed in claim 5 further comprising a band or clamp for securing the sensor module in the recess.

10. The bend stiffener as claimed in claim 1, wherein the sensor module carries a screw thread and the stiffener body comprises a complementary screw thread to receive and engage the sensor module, so that the sensor module is engageable with/disengageable from the stiffener body by rotation of the sensor module.

11. The bend stiffener as claimed in claim 1, wherein the stiffener body comprises a portion which tapers inwardly from its root toward its free end, a tip portion carrying the sensor module, and a flexible neck portion which couples the tapered portion to the tip portion.

12. The bend stiffener as claimed in claim 11, wherein the flexible neck portion comprises cut-aways and/or a reduced diameter region and/or a helical portion.

13. The bend stiffener as claimed in claim 1, wherein the sensor module is covered by a layer which is overmoulded on the stiffener body.

14. The bend stiffener as claimed in claim 1, wherein the sensor module has a handle or other engagement feature configured to be grasped by a tool of an ROV.

15. The bend stiffener as claimed in claim 1, wherein the sensor module comprises a pressure vessel having an exterior jacket.

16. The bend stiffener as claimed in claim 1 comprising multiple sensor modules configured to be active at different times.

17. A stiffener body for a bend stiffener, for locally protecting an elongate flexible member from excessive curvature when the elongate flexible member is deployed in water, the stiffener body comprising

- a root end,
- a free end, and
- a passage extending through the stiffener body from the root end to the free end for receiving and embracing the flexible member, the stiffener body having a tip portion at or proximate the free end which includes a recess configured to receive and mount a sensor module having
- sensors configured to sense inclination and/or orientation and/or movement of the free end of the bend stiffener,
- an onboard power supply, and
- a memory for logging sensor data,
- wherein the sensor module being removably mounted to the stiffener body enabling the sensor module to be recovered while the bend stiffener is deployed.

18. The stiffener body as claimed in claim 17, wherein the tip portion is coupled to the remainder of the stiffener body through a flexible neck portion.

19. The stiffener body as claimed in claim 17, wherein the tip portion is shaped to locate the sensor module axially and/or radially.

20. The stiffener body as claimed in claim 19, wherein the tip portion has a circumferential recess to locate the sensor module.

* * * * *